US010125541B2

(12) United States Patent
Zhang

(10) Patent No.: US 10,125,541 B2
(45) Date of Patent: Nov. 13, 2018

(54) WINDING MECHANISM, TOP RAIL ASSEMBLY AND WINDOW BLIND

(71) Applicant: Huicai Zhang, Qingxin (CN)

(72) Inventor: Huicai Zhang, Qingxin (CN)

( * ) Notice: Subject to any disclaimer, the term of this patent is extended or adjusted under 35 U.S.C. 154(b) by 0 days.

(21) Appl. No.: 15/471,520

(22) Filed: Mar. 28, 2017

(65) Prior Publication Data

US 2017/0198521 A1 Jul. 13, 2017

(30) Foreign Application Priority Data

Mar. 13, 2017 (CN) ..... 2017 1 0146625

(51) Int. Cl.
*E06B 9/322* (2006.01)

(52) U.S. Cl.
CPC ..... *E06B 9/322* (2013.01); *E06B 2009/3222* (2013.01); *E06B 2009/3227* (2013.01)

(58) Field of Classification Search
CPC ..... E06B 2009/3222; E06B 2009/3225; E06B 2009/3227; E06B 2009/322
See application file for complete search history.

(56) References Cited

U.S. PATENT DOCUMENTS 5,133,399 A * 7/1992 Hiller ..... E06B 9/30 160/170
5,259,433 A * 11/1993 Cloutier ..... E05D 13/14 160/190
5,791,393 A * 8/1998 Judkins ..... E06B 9/322 160/308
5,927,370 A * 7/1999 Judkins ..... E06B 9/262 160/291
6,325,131 B1 * 12/2001 Dekker ..... E06B 9/322 160/170
6,964,291 B2 * 11/2005 Judkins ..... E06B 9/32 160/170
2001/0035269 A1 * 11/2001 Judkins ..... E06B 9/322 160/84.05
2003/0178155 A1 * 9/2003 Fraczek ..... E06B 9/303 160/170
2009/0020239 A1 * 1/2009 Yu ..... E06B 9/322 160/331
2012/0125543 A1 * 5/2012 Chambers ..... E06B 9/304 160/5
2013/0248125 A1 * 9/2013 Lin ..... E06B 9/262 160/84.05
2014/0352895 A1 * 12/2014 Cheng ..... E06B 9/322 160/170
2017/0081914 A1 * 3/2017 Wu ..... E06B 9/266

* cited by examiner

*Primary Examiner* — Brian D Mattei
(74) *Attorney, Agent, or Firm* — Shimokaji IP

(57) ABSTRACT

A winding mechanism adapted for window blinds includes a shaft and at least one spiral groove configured on the shaft. The shaft has a wider first end and a narrower second end, and a diameter of the shaft is gradually reduced from the wider first end to the narrower second end, one end of a pull rope is connected with the shaft, and the other end of the pull rope is connected with slats, the pull rope in turn winds around the spiral groove from the wider first end to the narrower second end, or in turn disengages from the spiral groove from the narrower second end to the wider first end. The force moment of the pull rope is varied with the diameter of the shaft, thereby an effortless and quick operation to pull or lift the window blind is obtained, and no rebound or no falling problem happens.

14 Claims, 7 Drawing Sheets

WINDING MECHANISM, TOP RAIL ASSEMBLY AND WINDOW BLIND

RELATED APPLICATIONS

This application claims the benefit of priority to Chinese Invention Application No. 201710146625.2, filed Mar. 13, 2017, which is hereby incorporated by reference in its entirety.

FIELD OF THE INVENTION

The present invention relates to window blinds, and more particularly to a winding mechanism, a top rail assembly and a window blind including the same.

BACKGROUND OF THE INVENTION

In conventional window blinds, multiple slats are connected trapezoidal ropes that are extended between a top rail and a bottom rail, one or more pull ropes run through the slats and extend from the bottom rail to the top rail. The bottom rail will be raised towards the top rail under an upward force applied to the pull rope, in such a way the slats will be retracted from bottom to top. Due to restrictions of the blinds system and driving manner, the pull rope is longer than the total length of the window blinds after the window blinds are retracted, which brings potential strangulation hazard to children.

Cord-free window blinds are developed to solve the above problems, which use a spring driver as a driving source connected to a winding reel or a winding roller, and a pull rope wound around the winding reel or winding roller. On operation, the spring driver supplies a lift force to counteract the resultant force of the gravity of the slats and the force applied by a hand, by the means of balance force of the friction, the gravity; the force provided by the spring driver and the force applied the hand, the window blind can be retracted or extended at a desired position. However, such a balance is difficult to achieve by the spring driver. When the window blind is pulled, the force supported by the spring driver is reduced as the slats are support by the trapezoidal ropes. Contrarily, when the window blind is withdrawn, the force supported by the spring driver is increased due to the loads of the bottom rail and the slats. Thus some problems will be generated if the lift force provided by the spring driver is constant. For example, since the force supported by the spring driver is reduced gradually when the window blind is pulled down, thus the pull force of the hand must be increased gradually and will reach to the maximum at the bottom, and once the hand is loosed, the window blind will be rebounded due to the inertia. For preventing such a rebound, a counterweight must be added at the bottom of the window blind such as the bottom rail. When a hand lifts the bottom rail to retract the blind, the force supported by the spring driver is increased gradually, the lift force of the hand must be increased accordingly and will reach to the maxim mm at the top. Under this situation, the window blind may not be maintained at the top position, but fall down slowly. For improving this problem, one or more driving element is added at the top rail to increase the friction to balance the force supported by the spring driver.

However, the above structures are complicated and the cost is increased. In the mass production, the frictions become indefinite due to assembling process and different using ways, thus the rebound force, the frictions and the gravity may still mismatch to bring the unbalanced force.

Thus, there is a need to provide an improved winding mechanism, a top rail and a window blind to overcome the drawbacks mentioned above.

SUMMARY OF THE INVENTION

One objective of the present invention is to provide a winding mechanism with a simple structure, which changes force moments of a pull rope on the winding mechanism thus to maintain a substantially equal and balanced force of a hand during operations to the window blind, accordingly to bring an effortless and quick operations of retracting and extending, furthermore, the window blind may not rebound or fall once the hand is loosed.

Another objective of the present invention is to provide a top rail assembly fir a window blind having a winding mechanism, which changes force moments of a pull rope on the winding mechanism thus to maintain a substantially equal and balanced farce of a hand during operations to the window blind, accordingly to bring an effortless and quick operations of retracting and extending, furthermore, the window blind may not rebound or fall once the hand is loosed.

One more objective of the present invention is to provide a window blind having a winding mechanism, which changes force moments of a pull rope on the winding mechanism thus to maintain a substantially equal and balanced force of a hand during operations to the window blind, accordingly to bring an effortless and quick operations of retracting and extending, furthermore, the window blind may not rebound or fall once the hand is loosed.

To achieve the above-mentioned objectives, the present invention provides a winding mechanism adapted for window blinds and comprising a winding roller, the winding roller comprising a shaft and at least one spiral groove configured on the shaft. The shaft has a wider first end and a narrower second end, and a diameter of the shaft is gradually reduced from the wider first end to the narrower second end, one end of a pull rope is connected with the shaft, and the other end of the pull rope is connected with slats and a bottom rail of a window blind, the pull rope in turn winds around the spiral groove from the wider first end to the narrower second end, or in turn disengages from the spiral groove from the narrower second end to the wider first end.

As an embodiment, the mechanism further includes a guiding roller that is rotatably configured at a tangent of the winding roller, the pull rope is located between the guiding roller and the winding roller, and the winding roller is actuated to roll and generate a translational motion under an action of the guiding roller.

Preferably, the guiding roller comprises a main body and an bulged portion, the main body is tangent to a periphery of the winding roller, and the bulged portion is engaged with the spiral groove to push the winding roller to make the translational motion.

Preferably, the mechanism further includes a winding roller seat on which the winding roller is rotatably configured, and the guiding roller is rotatably mounted on the winding roller seat.

As another embodiment, the mechanism further includes a winding roller seat to which the winding roller is fixed, and the pull rope is connected to a driving unit.

The present invention provides a top rail assembly adapted for window blinds and comprising at least one winding mechanism and a driving unit, the winding mechanism comprising a winding roller, the winding roller comprising a shaft and at least one spiral groove configured on the shaft. The shaft has a wider first end and a narrower second end, and a diameter of the shaft is gradually reduced from the wider first end to the narrower second end, one end of a pull rope is connected with the shaft, and the other end of the pull rope is connected with slats and a bottom rail of a window blind, the pull rope in turn winds around the spiral groove from the wider first end to the narrower second end, or in turn disengages from the spiral groove from the narrower second end to the wider first end.

Preferably, the top rail assembly further comprises a guiding roller that is rotatably configured at a tangent of the winding roller, the pull rope is located between the guiding roller and the winding roller, and the winding roller is connected with the driving unit, the winding roller and the guiding roller are actuated to roll, and the winding roller generates a translational motion under an action of the guiding roller.

Preferably, the guiding roller comprises a main body and a bulged portion, the main body is tangent to a periphery of the winding roller, and the bulged portion is engaged with the spiral groove to push the winding roller to make the translational motion.

Preferably, the top rail assembly further comprises a winding roller seat on which the winding roller is rotatably configured, and the guiding roller is rotatably mounted on the winding roller seat.

Preferably, the driving unit comprises a driving source, a gear assembly connected with the driving source and a driving rod connected with the gear assembly and running through the shaft of the winding roller.

Preferably, at least one longitudinal groove is formed on the driving rod, at least one longitudinal rib is formed on inner walls of through hole of the shaft and engaged with the longitudinal groove, and the longitudinal rib is adapted to slide along the longitudinal groove.

As another embodiment, the top rail assembly further includes a winding roller seat to which the winding roller is fixed, and the pull rope is connected to a driving unit.

The present invention provides a window blind comprising a top rail assembly, a bottom rail and multiple slats that are movable relative to the top rail assembly, the top rail assembly comprises at least one winding mechanism and a driving unit, the winding mechanism comprising a winding roller, the winding roller comprises a shaft and at least one spiral groove configured on the shaft. Wherein the shaft has a wider first end and a narrower second end, and a diameter of the shaft is gradually reduced from the wider first end to the narrower second end, one end of a pull rope is connected with the shaft, and the other end of the pull rope is connected with the slats and the bottom rail, the pull rope in turn winds around the spiral groove from the wider first end to the narrower second end, or in turn disengages from the spiral groove from the narrower second end to the wider first end.

In comparison with the prior art, the window blind of the present invention supplies a roller with a tapered diameter to change the force moment of the pull rope on the roller, so as to make a pulling three and a lifting force of a hand applying to the window blind substantially constant and balanced, therefore an effortless and quick operation to pull or lift the window blind is obtained, and no rebound or no falling problem happens. In comparison of the conventional ones, the present invention has reduced cost and simple assembly to save time and manpower, the using life is extended, and the manufacturing method is easy, which is desired by the manufacturers.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
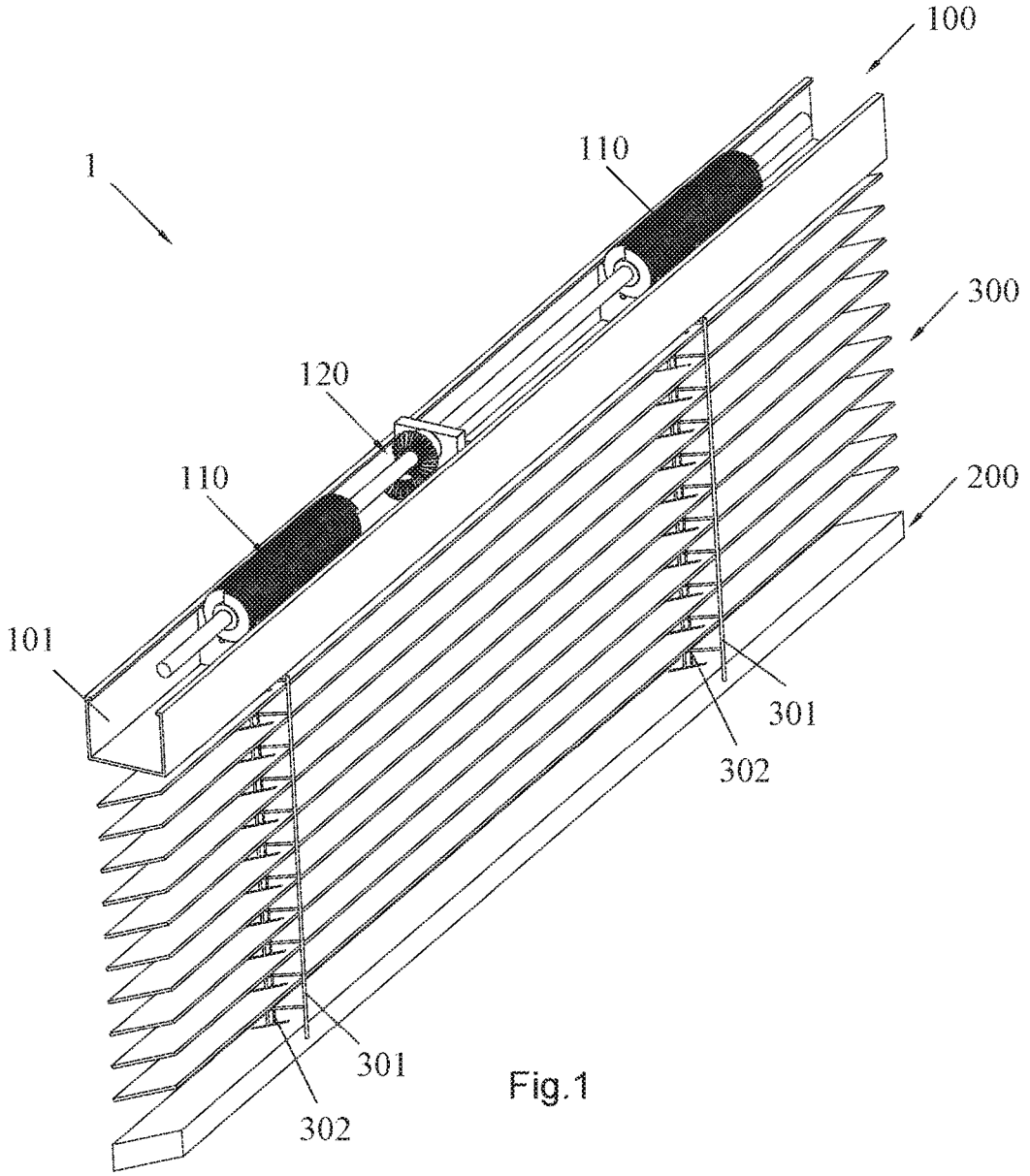
FIG. 1 is a partial perspective view of a window blind according to one embodiment of the present invention.

Various preferred embodiments of the invention will now be described with reference to the figures, wherein like reference numerals designate similar parts throughout the various views.

Figure 2:
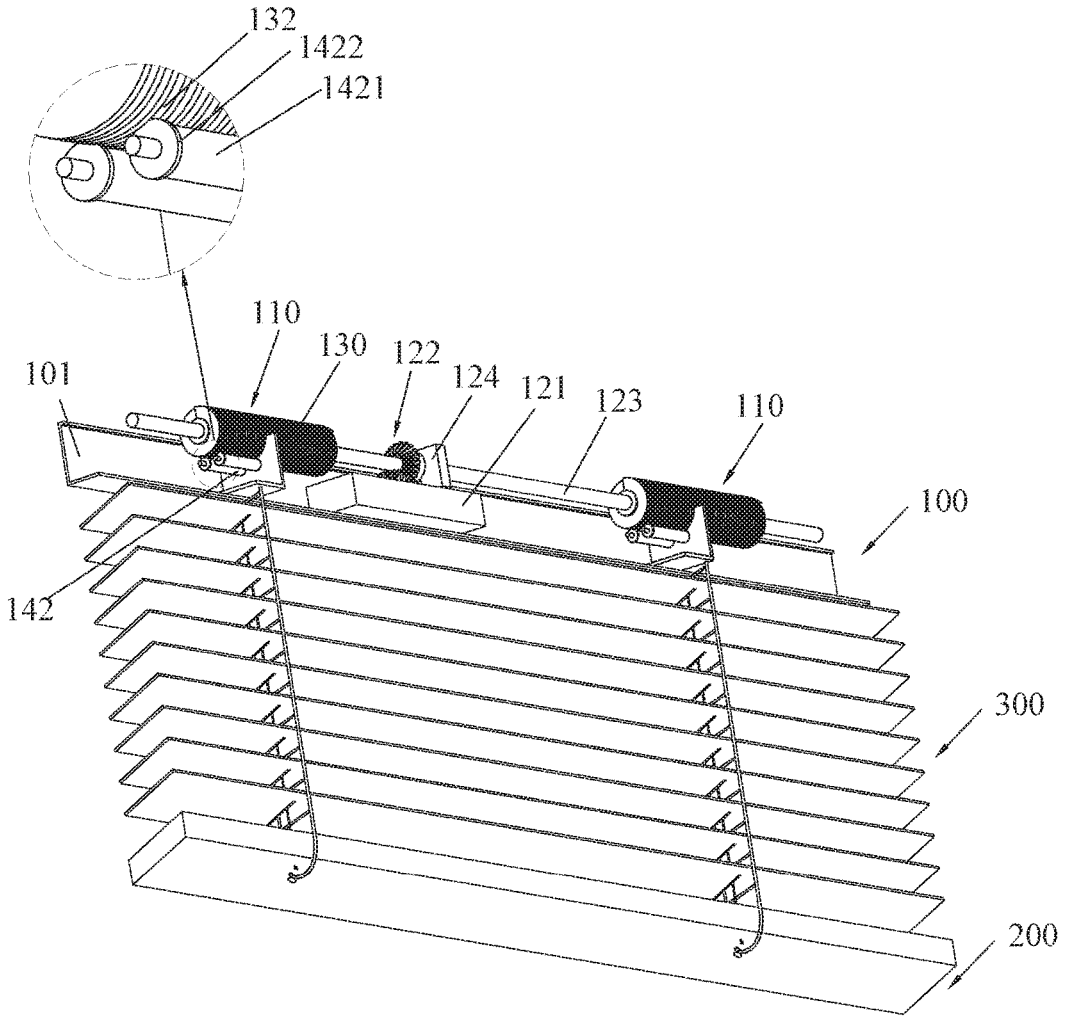
FIG. 2 is another partial perspective view and a partial enlarged view of the window blind according to one embodiment of the present invention.

Referring to FIGS. 1 and 2, a window blind 1 includes a top rail assembly 100, a bottom rail 200 and multiple slats 300 connected between the top rail assembly 100 and the bottom rail 200. The slats 300 will be extended if the bottom rail 200 is pulled down by a hand and will be extended if the bottom rail 200 is lifted up by a hand.

The slats 300 are connected and supported by a trapezoidal rope 301 extended between the top rail assembly 100 and the bottom rail 200, and a pull rope 302 is extended from the bottom rail 200 to the top rail assembly 100, runs through the slats 300 and winds around the top rail assembly 100.

Specifically, the top rail assembly 110 includes at least one winding mechanism 110 and a driving unit 120, which are installed in a U-shape rail 101 of the top rail assembly 110. As a preferred embodiment, the amount of the winding mechanism 110 is two, each of which is configured at two ends of the U-shaped rail 101 and connected to one pull rope 302 respectively. The driving unit 120 is configured between the two winding mechanisms 110 to actuate them to make the pull rope 302 to engage with or disengage from the winding mechanisms 110. For achieving the engagement and the disengagement, a relative motion between the pull rope 302 and the winding mechanism 110 is necessary, for example, the winding mechanism 110 is moved relatively to the pull rope 302, alternatively, the pull rope 302 is moved relatively to the winding mechanism 110. More specifically, the pull rope 302 is immovable in the horizontal direction, and the winding mechanism 110 rolls and moves linearly; alternatively, the winding mechanism 110 is immovable in the horizontal direction but rolls, and the pull rope 302 is movable linearly. Detailed structures and descriptions for the former one follow.

Figure 3:
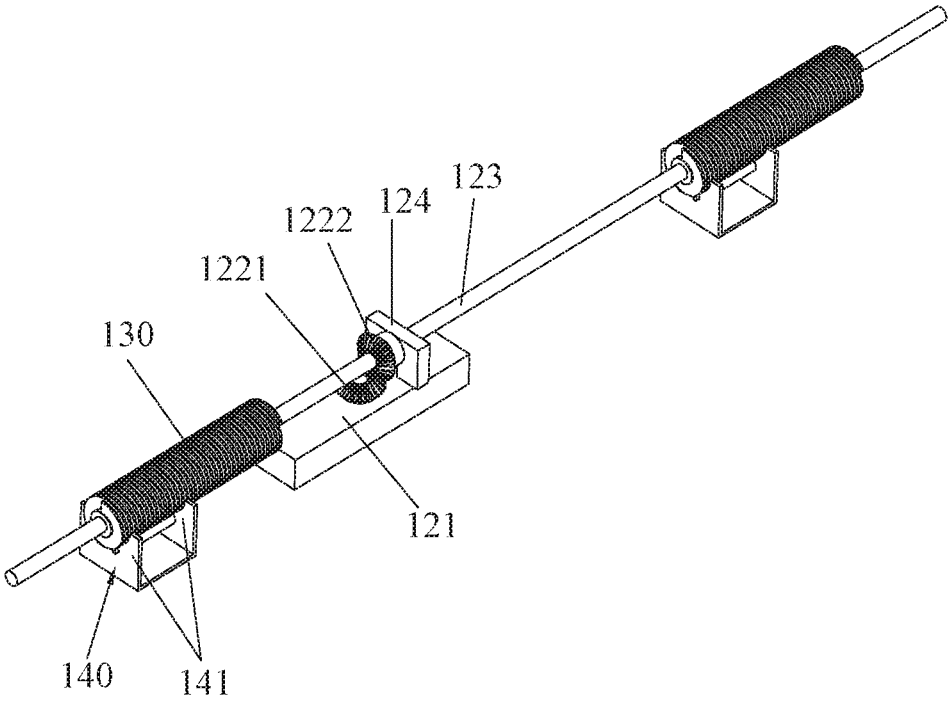
FIG. 3 is a partial perspective view of a top rail assembly according to one embodiment of the present invention.

Specifically, as illustrated in FIGS. 2 and 3, the winding mechanism 110 includes a winding roller 130 connected to the pull rope 302 and a winding roller seat 140 under the winding roller 130. The winding roller seat 140 is fixed to the bottom of the U-shaped rail 101 and has two support plates 141 at each end, and an arc notch is formed on the support plate 141 to cooperate with the winding roller 130.

Figure 4A:
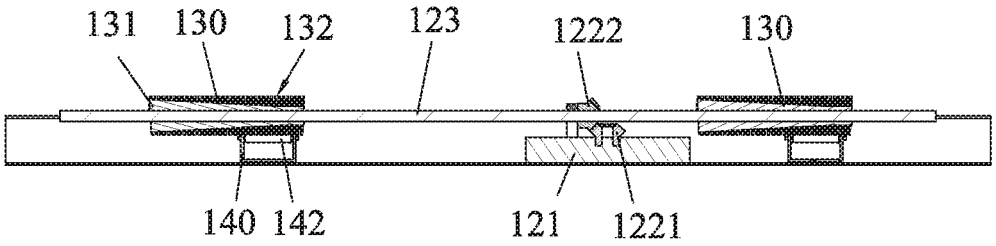
FIG. 4*a* is a sectional view of the top rail assembly according to the present invention.
Figure 4B:
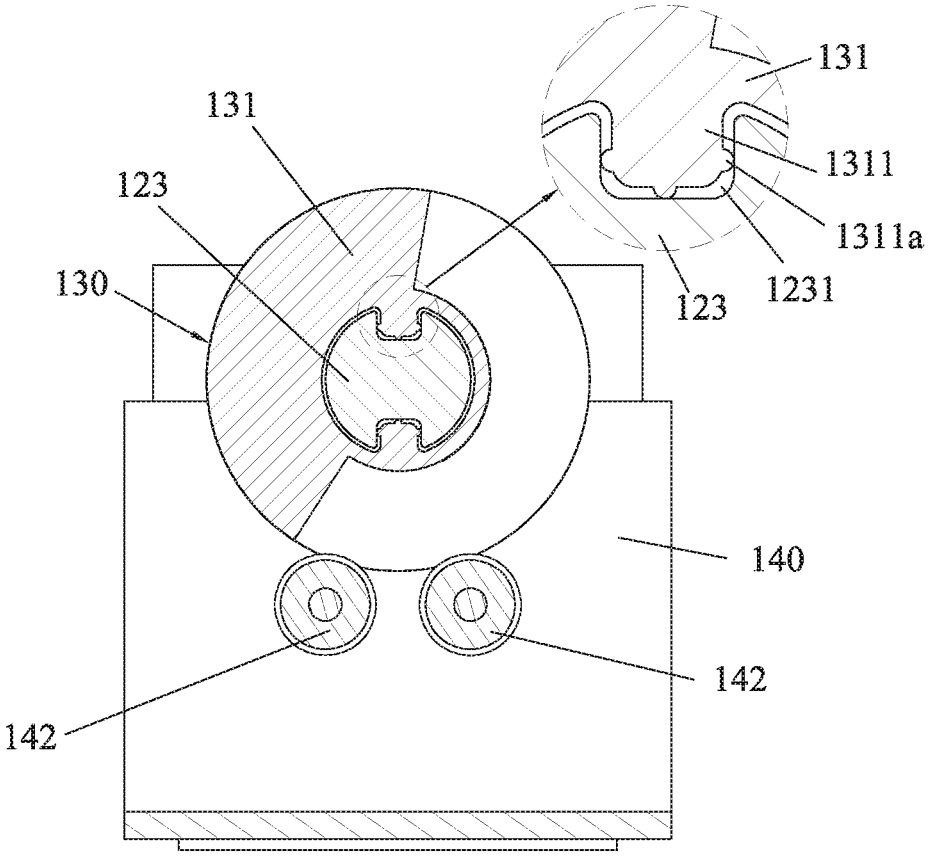
FIG. 4*b* is partial perspective view and a partial enlarged view of the top rail assembly according to one embodiment of the present invention.

Specifically, the support plate 141 will not restrict the movements of the winding roller 130 thereon, such as rolling or translating. As shown in FIGS. 4*a* and 4*b*, the winding roller 130 includes a shaft 131 and a spiral groove 132 configured on the shaft 131. Spacing for every circle of the spiral groove 132 is the same. Alternatively, the amount of the spiral groove 132 can be one or more. With the concept of the invention, the shaft 131 is a conical column, which has a wider first end and a narrower second end, and its diameter is decreased gradually from the first end to the narrower second end. A through hole is formed through the shaft 131 to allow a driving rod to pass. As shown in FIG. 4*b*, a guiding roller 142 is rotatably mounted on the winding roller seat 140 and located at the outer perimeter of the winding roller 130 and at a tangent of the winding roller 130, in such a way, the winding roller 130 is supported by the guiding roller 142. In detail, as shown in the enlarged portion of FIG. 2, the guiding roller 142 includes a main body 1421 and an bulged portion 1422 that is protruded from the main body 1421, the main body 1421 is at a tangent of the outer periphery of the winding roller 130, and the bulged portion 1422 is engaged with the spiral groove 132 of the roller 132. In other words, the outer periphery of the bulged portion 1422 is higher than that of the main body 1421, the bulged portion 1422 is inserted into one ring of the spiral groove 132 when the main body 1421 is located at a tangent of the outer periphery of the winding roller 130. Based on this configuration, when both of the winding roller 130 and the guiding roller 142 are rolled, the winding roller 130 will be actuated to make translational motion due to the engagement of the bulged portion 1422, so that the pull rope 302 can be engaged with or disengaged from the winding roller 130.

Figure 5:
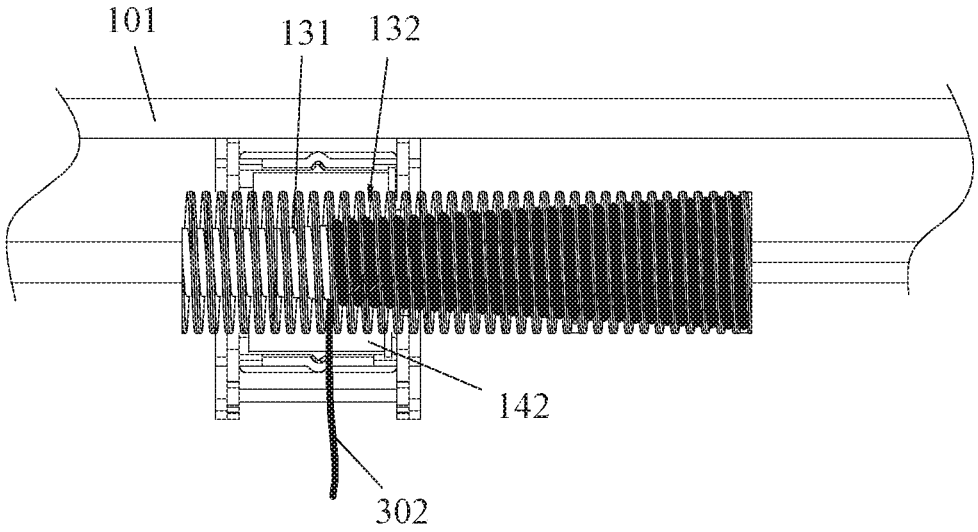
FIGS. 5-7 are partial views of the top rail assembly, showing several statuses of the pull rope winding on the winding mechanism.
Figure 6:
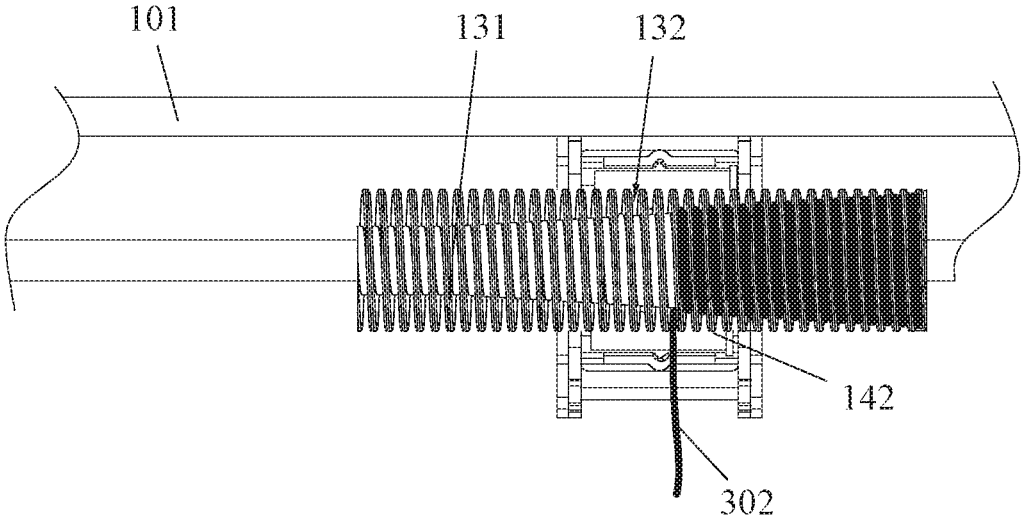
Figure 7:
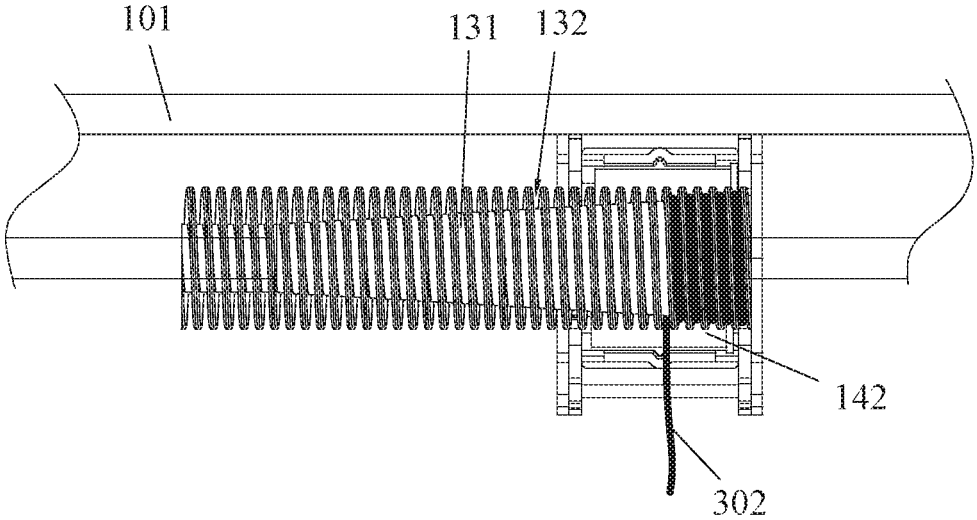

One end of the pull rope 302 is extended from the lower side of the guiding roller 142 to the winding roller 130, and the pull rope 302 is located between the guiding roller 142 and the winding roller 130 and pressed against a rolling surface of the guiding roller 142. Under the action of the guiding roller 142, the pull rope 302 in turn winds around the spiral groove 132 of the shaft 131 from the wider first end to the narrower second end or in turn disengages from the spiral groove 132 of the shaft 131 from the narrower second end to the wider first end to retract or extend the slats. Specifically, during the extending process of the window blind, the pull rope 302 disengages from the narrower second end to the wider first end and will be located at the wider first end when the window blind is completely extended, such as the pull rope 302 is located at the last ring or winded on several rings of the spiral groove 132 one the wider first end. During the extending process of the window blind, the pull rope 302 winds around the spiral groove 132 of the shaft 131 from the wider first end to the narrower second end and will occupy the spiral groove 132 on both of the wider first end and the narrower second end. For the clarity, the pull rope 302 is not shown in the winding roller 130 in FIGS. 1-4*b*, but shown in FIGS. 5-7.

As shown in FIG. 3, the driving unit 120 includes a driving source 121, a gear assembly 122 and a driving rod 123 connected with the gear assembly 122 and runs through the shaft 131 of the winding roller 130. Specifically, the driving source 121 fixed on the U-shaped rail 101 is served for supplying power, which may use the conventional spring driving units, such as leaf spring or wire spring, etc. The gear assembly 122 includes an active gear 1221 connected with the driving source 121 and a driven gear 1222 connected with the driving rod 123. Specifically, the active gear 1221 is fixed to the driving source 121, and the driven gear 1222 is located above the active gear 1221 and engaged with the active gear 1221, resulting the driving rod 123 is driven by the driven gear 1222. Preferably, both of the active gear 1221 and the driven gear 1222 are cone gears. To prevent the driven gear 1222 from making translational motion as the winding roller 130 during the rolling of the driving rod 123 and the winding roller 130, a limiting plate 124 is configured beside the driven gear 1222 and is fixed on two sides of the U-shaped rail 101 or the housing of the driving source 121. More specifically, the driven gear 1222 is located between the active gear 1221 and the limiting plate 124.

The driving rod 123 runs through the driven gear 1222 and the rollers 130 at the sides. As shown in FIG. 4*b*, one or more longitudinal grooves 1231 are formed on the driving rod 123, and one or more longitudinal ribs 1311 are formed on the inner wall of the through hole of the shaft 131, by means of the engagement of the longitudinal ribs 1311 and the longitudinal groove 1231, the driving rod 123 is connected with the winding roller 130, and the winding roller 130 can be moved along the longitudinal grooves 1231. Preferably, one or more longitudinal edges 1311*a* are formed on the longitudinal rib 1311 to engage with the inner wall of the longitudinal groove 1231. Based on these configurations, when winding roller 130 is driven to roll by the driving rod 123 and driven to move linearly by the guiding roller 142, the longitudinal ribs 1311 of the winding roller 130 can slide along the longitudinal grooves 1231 on the driving rod 123. Similarly, one or more longitudinal ribs (not shown) are provided on the inner wall of the through hole of the driven gear 1222, such that the driving rod 123 is engaged with the driven gear 1222. In such a way, the driven gear 1222 causes the driving rod 123 to roll and then actuate the winding roller 130 to roll accordingly.

By combination of FIGS. 1-7, the operation principles of the window blind 1 is explained as following. If there is a need to extend the window blind 1, under this status, the pull rope 302 is winded around the winding roller 130 and its end is winded on the narrower second end (referring to FIG. 5), a hand pulls down the bottom rail 200 to cause the pull rope 302 be tightened to move downwards accordingly, thus the winding roller 130 rolls under the actions of the driving unit and the external force of the hand, and the guiding roller 142 rolls as well under the actions of the friction among the winding roller 130, the pull rope 302 and the guiding winding roller 130; during the rolling of the guiding roller 142, the winding roller 130 is pushed to make translational motion (such as left movement) on the driving rod 132 because of the engagement between the bulged portion 1422 of the guiding roller 142 and the spiral groove 132 of the winding roller 130. With the pulling motion of the hand, the rolling and the translational motion of the winding roller 130, the pull rope 302 is disengaged from the spiral groove 132 gradually from the narrower second end to the wider first end of the shaft 131 (referring to FIG. 6 that shows one status), thus the force moment of the pull rope 302 thereon is gradually increased during the disengagement. Accordingly, a pulling force applied to the hand can be maintained substantially constant and balanced, without being increased gradually, although the weight supported by the driving unit is reduced gradually due to the extended slats, in such a way, an effortless operation to pull the window blind is obtained. Furthermore, the completely extended window blind will not rebound once the hand is loosed. If there is a need to retract the window blind 1, under this status, the pull rope 302 is located at the wider first end (referring to FIG. 7), a hand lifts up the bottom rail 200 to cause the winding roller 130 to roll under the actions of the driving unit and the external force of the hand, and the guiding roller 142 rolls as well under the actions of the friction among the winding roller 130, the pull rope 302 and the guiding winding roller 130; during the rolling of the guiding roller 142, the winding roller 130 is pushed to do translational motion (such as right movement) on the driving rod 132 because of the engagement between the bulged portion 1422 of the guiding roller 142 and the spiral groove 132 of the winding roller 130. As a result, the pull rope 302 is engaged with the spiral groove 132 gradually from the wider first end to the narrower second end of the shaft 131, thus the force moment of the pull rope 302 thereon is gradually reduced during the engagement. Accordingly, a lifting force applied to the hand can be maintained substantially constant and balanced, without being increased gradually, although the weight supported by the driving unit is increased gradually due to the retracted slats, in such a way, an effortless operation to lift the window blind is obtained. Furthermore, the completely retracted window blind will not fall down once the hand is loosed.

By this token, the window blind 1 of the present invention supplies a roller with a tapered diameter to change the force moment of the pull rope on the roller, so as to make a pulling force and a lifting force of a hand applying to the window blind substantially constant and balanced, therefore an effortless and quick operation to pull or lift the window blind is obtained, and no rebound or no falling problem happens. In comparison of the conventional ones, the present invention has reduced cost and simple assembly to save time and manpower, the using life is extended, and the manufacturing method is easy, which is desired by the manufacturers.

in another preferable embodiment, the window blind 1 further includes an angle adjusting mechanism (not shown) which is respectively connected with the shaft of the roller and the slats through a trapezoidal rope. When the shaft of the roller is rolling, the angle adjusting mechanism will be actuated to adjust the turn angle of the slats.

in another preferable embodiment, the winding mechanism 110 is configured to be merely rolled along the axis direction, but not moved linearly, and the pull rope 302 is connected to another driving unit (not shown) to move linearly and horizontally, in such a way, the pull rope 302 can wind around the spiral groove 132 in turn from the wider first end to the narrower second end of the shaft 131, or disengages from the spiral groove 132 in turn from the narrower second end to the wider first end of the shaft 131. In this case, the driving rod 123 should be fixed on the winding roller 130, and the guiding roller 142 does not engage with the winding roller 130 any more. Specifically, another driving unit including a driving wheel (not shown) or driving bar (not shown) actuates the pull rope 302 to make translational motion. The winding roller 130 has the same conical structure as the above embodiment, similarly, the force moment of the pull rope is varied with the diameter of the shaft 131 of the roller, thereby a pulling force to extend the window blind or a lift force to retract the window blind is substantially balanced and constant, but not required to increase gradually. Therefore an effortless and quick operation to pull or lift the window blind is obtained, and no rebound or no falling problem happens.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A winding mechanism, adapted for window blinds, the winding mechanism comprising a winding roller, the winding roller comprising a shaft and at least one spiral groove configured on the shaft, wherein a depth of the spiral groove gradually increases from a first end of the winding roller to a second end of the winding roller, the shaft has a wider first end and a narrower second end, and a diameter of the shaft is gradually reduced from the wider first end to the narrower second end, the spiral groove surrounds the shaft, the first end of the winding roller corresponds to the first end of the shaft, and the second end of the winding roller corresponds to the second end of the shaft so that the winding roller is cylindrical on the whole, one end of a pull rope is connected with the shaft, and the other end of the pull rope is connected with slats and a bottom rail of a window blind, the pull rope in turn winds around the spiral groove from the wider first end to the narrower second end, or in turn disengages from the spiral groove from the narrower second end to the wider first end; the winding mechanism further comprises a guiding roller that is rotatably configured at a tangent of the winding roller, the pull rope is located between the guiding roller and the winding roller, the winding roller is actuated to roll and generates a translational motion under an action of the guiding roller; and the guiding roller comprises a main body and a bulged portion, the main body is tangent to a periphery of the winding roller, and the bulged portion is engaged with the spiral groove to push the winding roller to make the translational motion.

2. The winding mechanism according to claim 1, further comprising a winding roller seat on which the winding roller is rotatably configured, and the guiding roller is rotatably mounted on the winding roller seat.

3. The winding mechanism according to claim 1, further comprising a winding roller seat to which the winding roller is fixed, and the pull rope is connected to a driving unit.

4. A top rail assembly, adapted for window blinds, the top rail assembly comprising at least one winding mechanism and a driving unit, the winding mechanism comprising a winding roller, the winding roller comprising a shaft and at least one spiral groove configured on the shaft, wherein a depth of the spiral groove gradually increases from a first end of the winding roller to a second end of the winding roller, the shaft has a wider first end and a narrower second end, and a diameter of the shaft is gradually reduced from the wider first end to the narrower second end, the spiral groove surrounds the shaft, the first end of the winding roller corresponds to the first end of the shaft, and the second end of the winding roller corresponds to the second end of the shaft so that the winding roller is cylindrical on the whole, one end of a pull rope is connected with the shaft, and the other end of the pull rope is connected with slats and a bottom rail of a window blind, the pull rope in turn winds around the spiral groove from the wider first end to the narrower second end, or in turn disengages from the spiral groove from the narrower second end to the wider first end; the winding mechanism further comprises a guiding roller that is rotatably configured at a tangent of the winding roller, the pull rope is located between the guiding roller and the winding roller, the winding roller is actuated to roll and generates a translational motion under an action of the guiding roller; and the guiding roller comprises a main body and a bulged portion, the main body is tangent to a periphery of the winding roller, and the bulged portion is engaged with the spiral groove to push the winding roller to make the translational motion.

5. The top rail assembly according to claim 4, further comprising a winding roller seat on which the winding roller is rotatably configured, and the guiding roller is rotatably mounted on the winding roller seat.

6. The top rail assembly according to claim 4, wherein the driving unit comprises a driving source, a gear assembly connected with the driving source and a driving rod connected with the gear assembly and miming through the shaft of the winding roller.

7. The top rail assembly according to claim 6, wherein at least one longitudinal groove is formed on the driving rod, at least one longitudinal rib is formed on inner walls of through hole of the shaft and engaged with the longitudinal groove, and the longitudinal rib is adapted to slide along the longitudinal groove.

8. The top rail assembly according to claim 4, further comprising a winding roller seat to which the winding roller is fixed, and the pull rope is connected to the driving unit.

9. A window blind, comprising a top rail assembly, a bottom rail and multiple slats that are movable relative to the top rail assembly, the top rail assembly comprising at least one winding mechanism and a driving unit, the winding mechanism comprising a winding roller, the winding roller comprising a shaft and at least one spiral groove configured on the shaft, wherein a depth of the spiral groove gradually increases from a first end of the winding roller to a second end of the winding roller, the shaft has a wider first end and a narrower second end, and a diameter of the shaft is gradually reduced from the wider first end to the narrower second end, the spiral groove surrounds the shaft, the first end of the winding roller corresponds to the first end of the shaft, and the second end of the winding roller corresponds to the second end of the shaft so that the winding roller is cylindrical on the whole, one end of a pull rope is connected with the shaft, and the other end of the pull rope is connected with the slats and the bottom rail, the pull rope in turn winds around the spiral groove from the wider first end to the narrower second end, or in turn disengages from the spiral groove from the narrower second end to the wider first end; the winding mechanism further comprises a guiding roller that is rotatably configured at a tangent of the winding roller, the pull rope is located between the guiding roller and the winding roller, the winding roller is actuated to roll and generates a translational motion under an action of the guiding roller; and the guiding roller comprises a main body and a bulged portion, the main body is tangent to a periphery of the winding roller, and the bulged portion is engaged with the spiral groove to push the winding roller to make the translational motion.

10. The window blind according to claim 9, further comprising a winding roller seat on which the winding roller is rotatably configured, and the guiding roller is rotatably mounted on the winding roller seat.

11. The window blind according to claim 9, wherein the driving unit comprises a driving source, a gear assembly connected with the driving source and a driving rod connected with the gear assembly and miming through the shaft of the winding roller.

12. The window blind according to claim 11, wherein at least one longitudinal groove is formed on the driving rod, at least one longitudinal rib is formed on inner walls of through hole of the shaft and engaged with the longitudinal groove, and the longitudinal rib is adapted to slide along the longitudinal groove.

13. The window blind according to claim 9, further comprising an angle adjusting mechanism which is respectively connected with the shaft of the roller and the slats, to change a turn angle of the slats.

14. The window blind according to claim 9, further comprising a winding roller seat to which the winding roller is fixed, and the pull rope is connected to the driving unit.

* * * * *